US008398453B2

(12) United States Patent
Mitchell et al.

(10) Patent No.: US 8,398,453 B2
(45) Date of Patent: Mar. 19, 2013

(54) TUBULAR SEAMLESS KNITTED BRASSIERE AND METHOD OF MAKING SAME

(75) Inventors: John Mitchell, High Point, NC (US); Heinz Altman, Winston-Salem, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 484 days.

(21) Appl. No.: 12/713,286

(22) Filed: Feb. 26, 2010

(65) Prior Publication Data

US 2011/0212668 A1 Sep. 1, 2011

(51) Int. Cl.
*A41C 3/00* (2006.01)

(52) U.S. Cl. ..... 450/65; 450/66

(58) Field of Classification Search ..... 450/74–76, 450/70, 67, 69, 66, 65; 66/169 R, 170, 171, 66/189, 190, 202, 172 R, 172 E
See application file for complete search history.

(56) References Cited

U.S. PATENT DOCUMENTS

| | | | | |
|---|---|---|---|---|
| 3,537,279 | A | 11/1970 | Epley | |
| 4,531,525 | A | 7/1985 | Richards | |
| 5,479,791 | A | 1/1996 | Osborne | |
| 5,553,468 | A | 9/1996 | Osborne | |
| 5,592,836 | A | 1/1997 | Schuster et al. | |
| 5,605,060 | A | 2/1997 | Osborne | |
| 6,125,664 | A | 10/2000 | Browder, Jr. | |
| 6,287,168 | B1 | 9/2001 | Rabinowicz et al. | |
| 6,645,040 | B2 | 11/2003 | Rabinowicz et al. | |
| 6,705,128 | B1 | 3/2004 | Sciacca | |
| 6,739,158 | B2 | 5/2004 | Sciacca et al. | |
| 6,739,159 | B2 | 5/2004 | Sciacca et al. | |
| 6,779,367 | B2 * | 8/2004 | Mitchell et al. | 66/176 |
| 6,907,759 | B2 | 6/2005 | Sciacca | |
| 6,912,876 | B2 | 7/2005 | Wallis et al. | |
| 7,028,509 | B2 * | 4/2006 | Mitchell et al. | 66/176 |
| 7,051,557 | B2 * | 5/2006 | Mitchell et al. | 66/179 |
| 2003/0019252 | A1 | 1/2003 | Sciacca | |

FOREIGN PATENT DOCUMENTS

| | | | |
|---|---|---|---|
| FR | 1570295 | A | 6/1969 |
| FR | 2220150 | A5 | 9/1974 |
| WO | WO-0136729 | A1 | 5/2001 |
| WO | WO-0168964 | A1 | 9/2001 |
| WO | WO-0183865 | A1 | 11/2001 |
| WO | WO-0194670 | A1 | 12/2001 |

OTHER PUBLICATIONS

Australian Government IP Australia, Emma Francis, Patent Examination B, Office Action in AU Patent Application No. 2010200760, dated Apr. 11, 2011.
International Search Report for International Application No. PCT/US2010/025578, Feb. 2010.

* cited by examiner

*Primary Examiner* — Gloria Hale
(74) *Attorney, Agent, or Firm* — Womble Carlyle Sandridge & Rice LLP

(57) ABSTRACT

A seamless knitted brassiere includes a body encircling portion and at least one shoulder strap knit therein. The shoulder strap has a length and a first welt along the length. The shoulder strap also has a second welt along the length and adjacent the first double welt. The shoulder strap also has a novel run guard adjacent either of the two welts.

13 Claims, 5 Drawing Sheets

TUBULAR SEAMLESS KNITTED BRASSIERE AND METHOD OF MAKING SAME

FIELD OF THE INVENTION

The present invention is related to brassieres, and particularly to a novel seamless knitted brassiere.

BACKGROUND OF THE INVENTION

Seamless garments are substantially completed garments formed on knitting machines and offer several advantages to garment manufacturers. Design flexibility, manufacturing simplicity, and near-complete automation of the garment production process are just a few. For example, many types of garments are possible including outerwear, e.g., sweaters, and undergarments, e.g. brassieres, underwear, etc. Because knitting machines form substantially all of the garments, little additional processing is required for these garments to be "ready-to-wear."

Consumers value dimensional stability in garments. Dimensional stability can be thought of as the ability of a garment to maintain its shape during wear. Dimensional stability may be influenced by garment design, fabric structure in the garment, and yarn construction. For seamless garments, however, the various openings in the garments and the absence of seams undermine garment dimensional stability. Because the openings in seamless garments are typically formed in a single fabric, the garment is subject to distortion and may not maintain its shape over the life of the garment. The absence of sewn seams, which improve the strength and durability of a garment, may limit the ability of a garment to withstand and recover from distortion.

While seamless garments have been made, none have addressed the challenges of producing a seamless knitted brassiere with targeted areas of dimensional stability. There is a need, therefore, for an improved seamless knitted brassiere, and in particular for a seamless knitted brassiere with improved strap and brassiere stability.

DETAILED DESCRIPTION OF THE INVENTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

Figure 1:
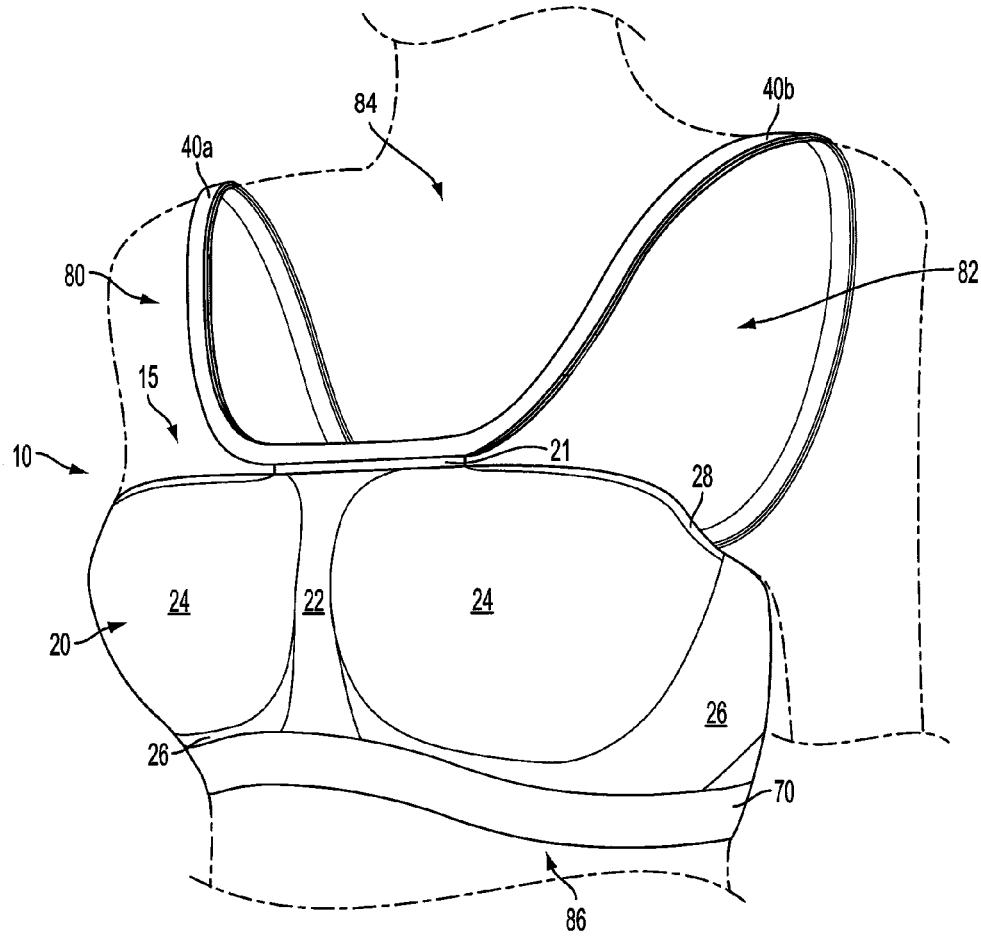
FIG. 1 shows a front perspective view of a seamless knitted brassiere.
Figure 2:
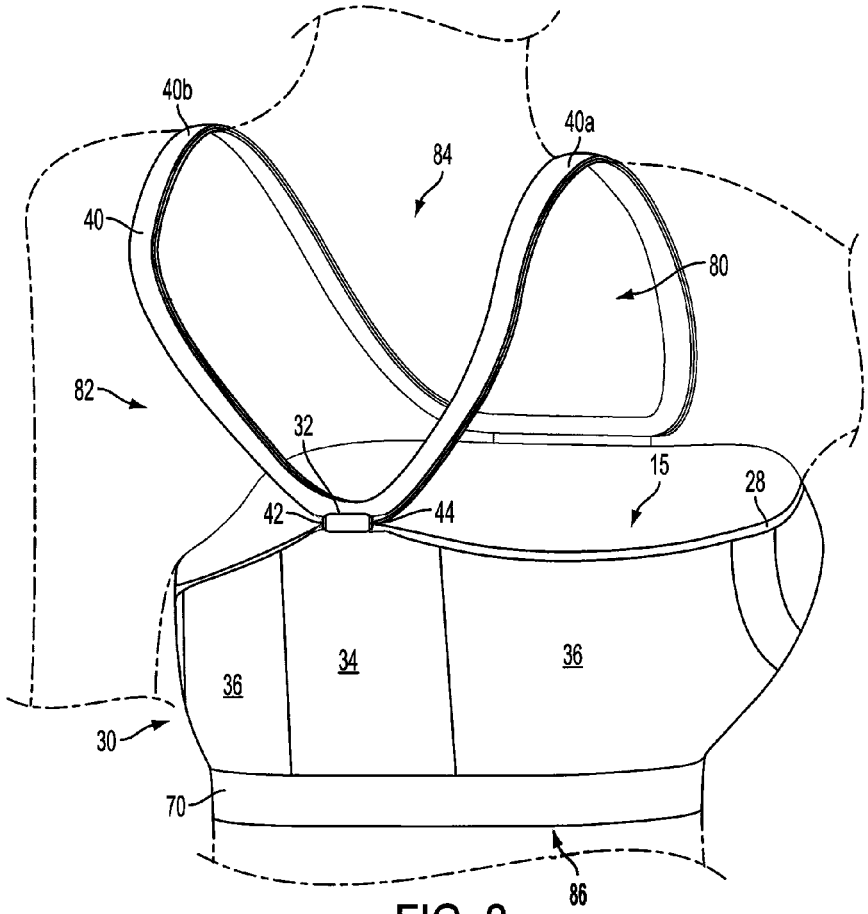
FIG. 2 shows a back perspective view of a seamless knitted brassiere.

As shown in FIG. 1, the seamless knitted brassiere 10 is generally formed as tubular knitted fabric that includes a body-encircling portion 15 with a front 20 and back 30 (shown in FIG. 2). A shoulder strap 40 is integrally knit into portions of the front 20 and back 30 and forms the arm openings 80 and 82, and the neck opening 84. The strap 40 includes at least two welts and first run guard 64. A second run guard 28 is formed on the top edge of the body-encircling portion 15. The lower edges of the brassiere 10 may include a welted band 70 that circumscribes the torso opening 86. In other embodiments, other types of finished edges may form the lower edge of the brassiere 10.

As shown in FIG. 1, the front 20 of the brassiere 10 includes breast cups 24, a front central area 22 and underbust areas 26 bordering the breast cups 24, and a strap engagement portion 21. The strap 40 is knit into the brassiere 10 at the strap engagement portion 21. At the upper edge of the body-encircling portion 15 is a run guard 28 (also shown on the back 30 in FIG. 2) that prevents unraveling of the fabric, creates a smooth edge, and provides cushion for the wearer. The strap engagement portion, breast cups, front central and underbust areas 21, 22, 24, and 26, however, may have any shape, size or knit construction. For example, the various knitted areas of the brassiere may be formed with single jersey stitches, knit-miss stitches, alternating knit-miss stitches, and may include held stitches for one or more courses.

As shown in FIG. 2, the back 30 includes back areas 34 and 36. The shoulder strap 40 may be knit into the back 30. In an embodiment, the strap is knit into the back strap engagement portion 32 at the first and second transition zones 42 and 44. As described above for the front 20 of the brassiere, the shape, size and construction of the back knitted areas 32, 34, 36, and transition zones 42 and 44 may be modified. For example, the back knitted areas 32, 34 and 36 may include, but are not limited to, single jersey stitches, knit-miss stitches, alternating knit-miss stitches, and may include held stitches for one or more courses.

The various knitted areas of the brassiere 10 may be formed with a variety of knit constructions and shapes, and are not limited to the specific sizes or shapes shown in the Figures. For example, the shape and size of the breast cups may be modified depending on the size of the brassiere needed, e.g., 32A, 34C, etc. For example, a larger or smaller underbust 26 may be used to augment the breast cups 24.

Referring again to FIGS. 1 and 2, the shoulder strap 40 is knit along a portion of its circumferential length into the brassiere 10 above each of the breast cups 24, while also being knit along a portion of its length with the back 30 of the brassiere. In the embodiments shown in FIGS. 1 and 2, the shoulder strap 40 is knit with the back 30 to a lesser degree than the amount of shoulder strap 40 that is knit into the front 20 of the body-encircling portion 15. While the embodiment shown includes a single shoulder strap 40, portions of which are knit into the body-encircling portion 15, other embodiments may include two shoulder straps knit into the body-encircling portion 15. For example, the terminal ends of two shoulder straps may be knit into the body-encircling portion 15.

Figure 3:
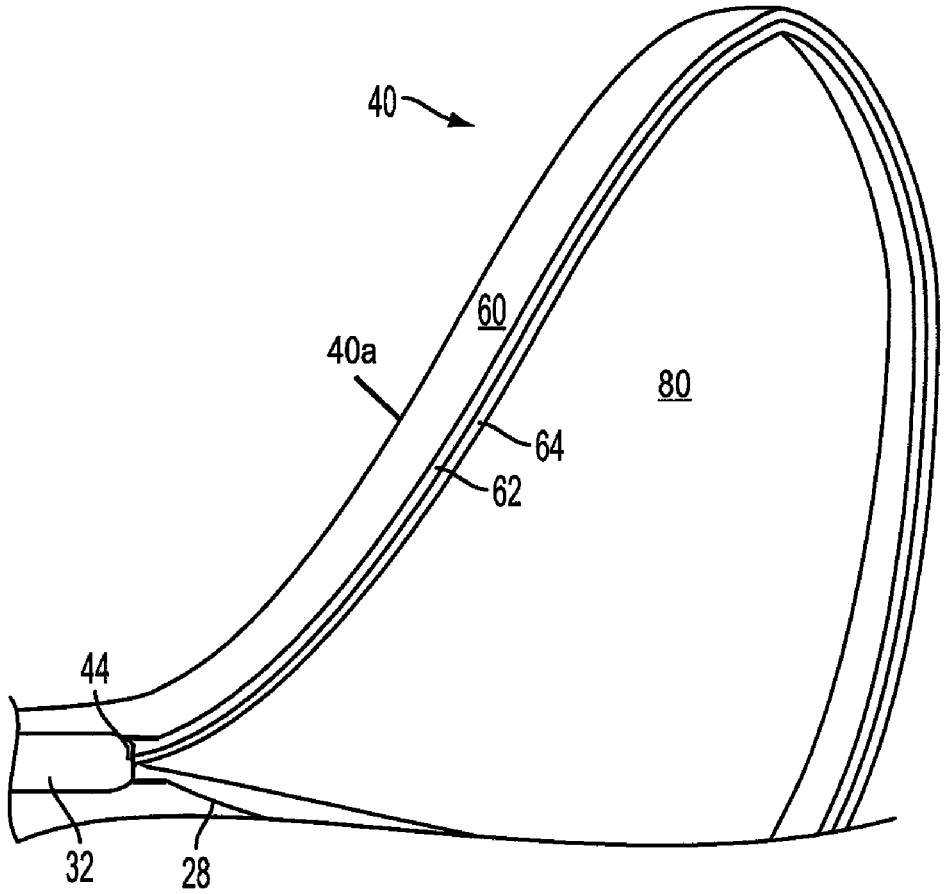
FIG. 3 shows a detailed view of one of the shoulder straps of a seamless knitted brassiere shown in FIGS. 1 and 2.

As shown in FIG. 3, shoulder strap 40 includes first and second welts 60 and 62, along the length of the strap. The second welt 62 is formed along the length of the strap adjacent the first welt 60. The first and second welts 60 and 62 may, for example, be a double welt or a welted edge. The strap 40 also includes first run guard 64 along the edge of the welts 60 and 62 that bounds the arm opening 80 (or 82). Two welts 60 and 62 in the shoulder strap 40 improve brassiere stability, prevent the straps from unraveling during use, and also provide cushion for the wearer. In an exemplary embodiment, the welts 60 and 62 may have different widths. In an embodiment, the first welt 60 may have width greater than the width of the second welt 62. In other embodiments, however, the widths of the welts 60 and 62 may have substantially the same width.

Referring to FIG. 3, the welt 60 may be formed of several knitted courses that are turned to yield a smooth edge. The width of the welt 60 may be influenced in part by the number of courses knit into the welt, yarn tension and fiber properties.

As shown in FIG. 3, the welted edge 62 is formed adjacent the welt 60. In one embodiment, the welted edge 62 is formed of a combination of knit-miss stitches, with certain stitches held for several courses, for example for 16 courses. In another embodiment, the welt edge 62 includes 1×1 knit-miss stitches, with the alternating missed stitches held for 6 courses, followed by two missed stitch courses, and another 6 courses of 1×1 knit-miss stitches with the alternating stitches held therein. A second set of two missed stitch courses introduce formation of the first run guard 64.

Referring again to FIG. 3, the run guard 64 has a construction that includes knit-miss alternating stitches, single jersey stitches, and held stitches over several courses. The construction of the run guard 64 may limit unraveling on the strap, but also creates a smooth, finished edge, while also providing more cushion and comfort along the straps edge. In an embodiment, the run guard 64 is knit over 12 courses, however, the run guard may be formed over fewer or lesser courses. For example, the run guard includes single jersey stitches, 1×1 alternating knit-miss stitches, 1×1 knit-miss stitches, and 1×1 knit-miss stitches with held stitches for a plurality of courses. In one exemplary embodiment, the courses in the run guard 64 include the following stitches: two courses of 1×1 alternating knit-miss stitches beginning with a missed stitch; a course of single jersey stitches; two to three courses of 1×1 knit-miss stitches with missed stitches held for each of the two or three courses, the first of the two or three courses beginning with a knit stitch; two courses of 1×1 knit-miss stitches with held stitches for two courses, the knit-miss stitches alternating with the preceding course; and a terminal course of 1×1 knit-miss stitches alternating with the preceding courses, and beginning with a knit stitch.

Referring to FIG. 3, the first and second transitions zones 42 (not shown in FIG. 3) and 44 join the shoulder strap 40 to the strap engagement portion 32. The transition zones 42 and 44 include held stitches that improve strap stability and ease the tension exerted at the strap engagement portion 32 and back areas 34 and 36 (shown in FIG. 2) when the brassiere 10 is worn. Further, the transition zones 42 and 44 include the press-off, or lock stitch at the arm openings 82 and 80, respectively. In an embodiment, the knit structure at the transition zones 42 and 44 include three held stitches for about five courses. The held stitches in these transition zones 42 and 44 increase the mass of material where the shoulder strap 40 and the body encircling portion 15 meet.

Referring to FIG. 2, the strap engagement portion 32 is generally less extensible than other knitted areas of the brassiere, e.g., the back panels 36, and provide for a more dimensionally stable brassiere. In an exemplary embodiment, the strap engagement portion 32 has 1×1 knit-miss stitches for five courses, followed by a jersey stitch at the sixth course. In other embodiments, different knit constructions may be used, e.g., 1×1, 1×2, or 1×3 alternating knit-miss stitches may be used with alternating courses of jersey stitches. In other embodiments, 1×2 alternating knit-miss stitches may be used with non-alternating courses of jersey stitches. The strap engagement portion 32, in conjunction with the held stitches at the transition zones 42 and 44, facilitates a smooth mechanical transition from the shoulder strap 40 down the back 30 of the brassiere 10.

As described above, a circular knitting machine is used to form seamless knitted brassiere 10 that comprises a tubular knitted fabric. An exemplary circular knitting machine includes a cylinder and dial. The cylinder includes a plurality of cylinder needles housed therein, linked to a cam system that controls needle movement. The dial has a plurality of dial bits arranged perpendicularly with the cylinder needles. The dial bits are operably linked to the cylinder and cam system to coordinate formation of different parts of the brassiere 10 discussed above. Each, or a predetermined set, of the cylinder needles and dial bits may be selectively engaged to form the seamless knitted brassiere 10. This selective disengagement may be used to form specific knit structures and/or the arm openings 80 and 82 described above.

In one embodiment, the circular knitting machine is set up with eight yarn feeders. Not every feeder needs to be activated. For example, only six feeders may be used. So configured, each rotation of the cylinder could yield six knitted courses of a tubular knitted fabric. Further, each yarn feed may introduce one or more yarns as needed. Accordingly, the brassiere 10 may be formed from a variety of fiber types and yarn structures. Exemplary fiber types include, but are not limited to, cotton, rayon, polyester, polyolefin, polyamide 6, polyamide 6,6, elastane, and spandex. Blended fibers also may be used such as cotton polyester. The yarn structures may be spun yarns such as ring spun, open-end, and air-jet spun staple yarns. In other embodiments, the yarns may be continuous multifilament yarns, either textured or non-textured.

Figure 4A:
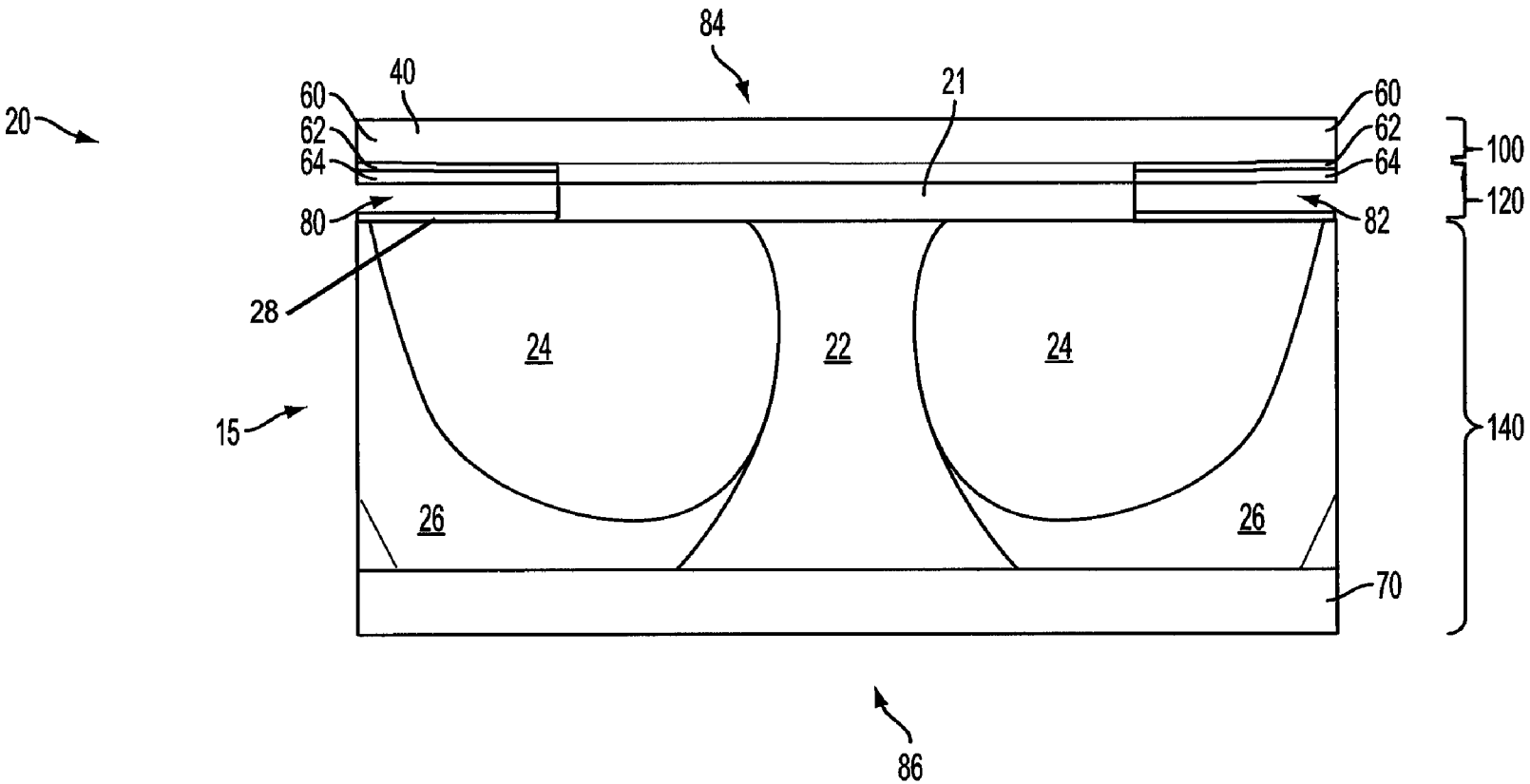
FIGS. 4A and 4B are schematics of a tubular knitted fabric that forms the front and back of a seamless knitted brassiere.
Figure 4B:
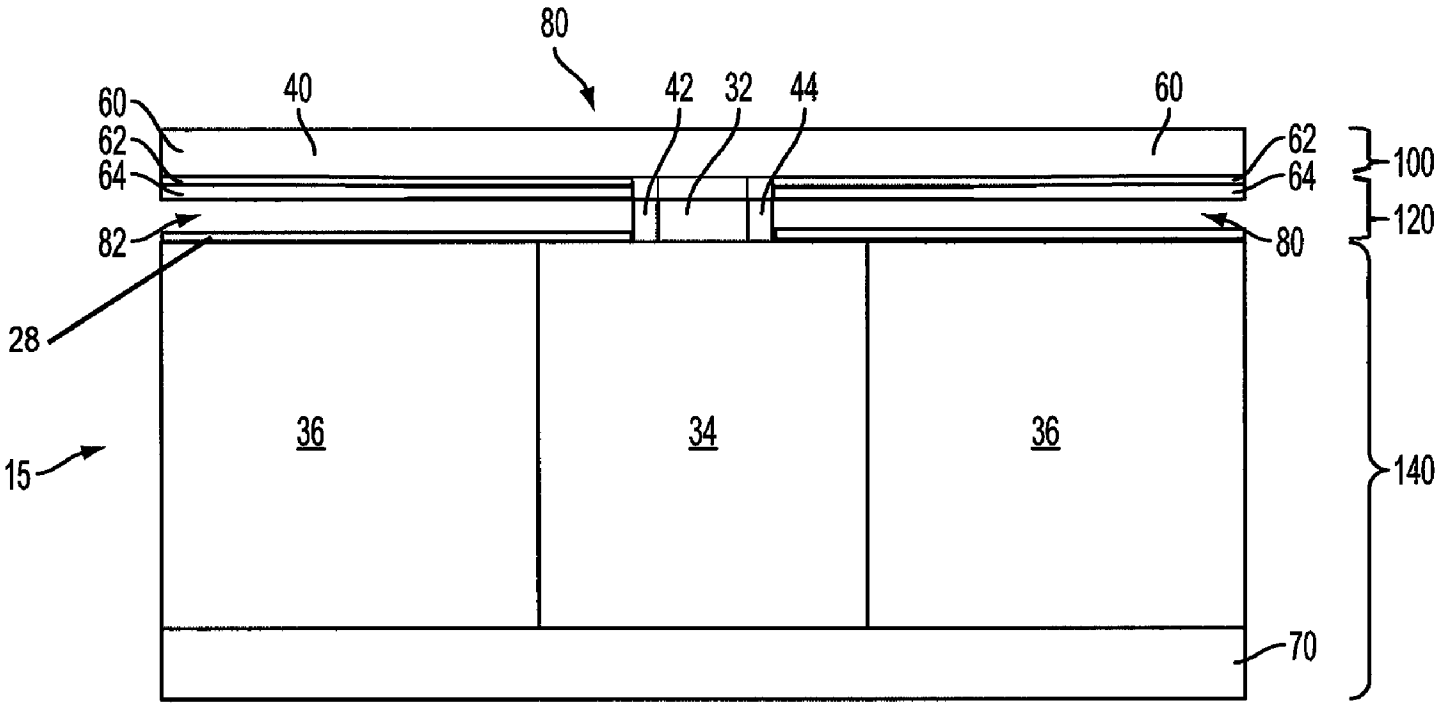

FIGS. 4A and 4B shows schematic diagrams of the front 20 and back 30 of the tubular knitted fabric that forms the seamless knitted brassiere 10, and indicates the general progression of knitting through steps 100, 120 and 140. The knitting diagrams show the front and back of the brassiere in two figures for illustrative purposes only.

Referring again to FIGS. 4A and 4B, the first step 100 may include forming the first welt edge 60 of the shoulder strap 40. The initial several rotations of the cylinder form the first double welt 60, while the dial bits hold a certain number of stitches until the desired size of the welt is achieved. For example, with a six active feeder used, each rotation of the cylinder forms six knitted courses. A welt with 42 courses would be formed with seven rotations of the cylinder. When the welt 60 is complete, the dial bits release the stitches and the first course of the second welted edge 62 is knit which begins step 120 shown in FIGS. 4A and 4B.

Referring again to FIGS. 4A and 4B, the second step 120 forms the welted edge 62, run guard 64, transition zones 42 and 44, strap engagement portions 32 and 21, and the arm openings 80 and 82. The second step 120 begins when a certain segment of needles in the circular knitting machines are inactivated, while the remaining activated needles knit the front strap engagement portion 21 shown in FIG. 4A, and the transition zones 42 and 44, and back strap engagement portion 32 shown in FIG. 4B. While the knitted portions 21, 32 and transition zones 42, 44 are knit, a certain number of feeders are also withdrawn from the cylinder needles to form the arm openings 80 and 82.

Referring again to FIGS. 4A and 4B, the third step 140 includes knitting the body-encircling portion 15. This step begins with knitting the second run guard 28. Similar to the run guard 64 on the strap 40, the second run guard may include a combination of courses that include, but are not limited to, 1×1 alternating knit-miss stitches, single jersey stitches, and 1×1 knit-miss stitches with held stitches for several courses. Upon formation of the run guard 28, one or more courses of the body-encircling portion 15 is knit. As described above, the cylinder is continuously rotated while the knitting action is adjusted to form the particular knit structures, and to account for the different shapes of the breast cups 24, front central area 22, under bust 26, and back portions 34 and 36. For example, in an embodiment, the breast cups 24 may be formed with single jersey stitches. The underbust 26 may be formed to include one or more upper knit-miss stitch combinations. The back areas 36 may include 1×1 knit-miss stitches, while the central back area 34 may have 1×3 knit-miss stitches in alternating courses.

As shown in FIGS. 4A and 4B, formation of the welted band 70 is formed around the lower circumferential edge of the brassiere 10 to complete step 140. After the last courses of the underbust 26, front central area 22, and back portions 34 and 36 are knit, the dial bits hold the knit stitches as the welted band 70 is knit. When the desired length of the welt is knit, the dial bits transfer the stitches to the cylinder needles and the completed brassiere 10 is expelled from the knitting machine. The brassiere 10 may be further processed as needed, for example washing, dying and finishing. The brassiere 10 is then packaged for distribution to the consumer.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A circularly knitted brassiere comprising:

a circularly knitted body encircling portion having a front, a back, and an upper edge; and at least one shoulder strap circularly knitted into the upper edge of the body encircling portion at the front and back, the shoulder strap having a length, a first welt along the length, and a second welt along the length parallel and adjacent the first welt.

2. The circularly knitted brassiere of claim 1, wherein the shoulder strap is circularly knitted into the back with at least one held stitch.

3. The circularly knitted brassiere of claim 1, wherein the shoulder straps further comprise a run guard, the run guard comprising a plurality of courses having knit-miss alternating stitches, single jersey stitches, and held stitches over two or more of the plurality of courses.

4. The circularly knitted brassiere of claim 1, wherein the first welt has a first width, and the second welt has a second width that is substantially equal to or greater than the first width.

5. The circularly knitted brassiere of claim 2, wherein the back further comprises a plurality courses of 1×1 knit-miss stitches.

6. A circularly knitted brassiere comprising:

a circularly knitted body encircling portion having a front, a back, and an upper edge;

a shoulder strap having a length, a first portion of the length circularly knitted into the upper edge at the back and having at least one held stitch; and a run guard along the length of the knitted shoulder strap, the run guard comprising a plurality of courses having knit-miss alternating stitches, single jersey stitches, and held stitches over two or more of the plurality of courses.

7. The circularly knitted brassiere of claim 6, wherein the strap further comprises a first welt along the length, and a second welt along the length parallel and adjacent the first welt, either the first or second welt adjacent the run guard.

8. The circularly knitted brassiere of claim 6, wherein the first welt has a first width, and the second welt has a second width that is equal to or greater than the first width.

9. The circularly knitted brassiere of claim 6, wherein the front and back further comprise a plurality of courses of 1×1 knit-miss stitches.

10. A method of forming a brassiere on a circular knitting machine, the method comprising:

circularly knitting a shoulder strap with a length, the shoulder strap having a first welt along the length, a second welt along the length parallel and adjacent the first welt; and circularly knitting a body encircling portion with a front, a back, and an upper edge, the shoulder strap being circularly knitted into the upper edge of a portion of the front and a portion of the back to form the circularly knitted brassiere.

11. The method of claim 10, wherein the portion of the shoulder strap circularly knitted into the back of the body encircling portion comprises at least one held stitch.

12. The method of claim 10, wherein the knitting of the shoulder strap further comprises knitting a run guard, the run guard comprising a plurality of courses having knit-miss alternating stitches, single-jersey stitches, and held stitches over two or more of the plurality of courses.

13. The method of claim 12, wherein the first welt has a first width, and the second welt has a second width that is equal to or greater than the first width.

* * * * *